US010251481B2

(12) United States Patent
Goetz

(10) Patent No.: US 10,251,481 B2
(45) Date of Patent: Apr. 9, 2019

(54) SLIDE-IN DEVICE FOR MOVEABLE FURNITURE PARTS

(71) Applicant: Julius Blum GmbH, Hoechst (AT)

(72) Inventor: Christof Goetz, Lustenau (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 15/969,323

(22) Filed: May 2, 2018

(65) Prior Publication Data

US 2018/0249833 A1 Sep. 6, 2018

(30) Foreign Application Priority Data

Nov. 20, 2015 (AT) ..... 750/2015

(51) Int. Cl.
*E05F 1/16* (2006.01)
*E05F 5/00* (2017.01)
(Continued)

(52) U.S. Cl.
CPC ..... *A47B 88/467* (2017.01); *A47B 88/437* (2017.01); *A47B 88/49* (2017.01);
(Continued)

(58) Field of Classification Search
CPC ..... A47B 88/467; A47B 88/47; A47B 88/46; E05F 1/16; E05F 5/027
See application file for complete search history.

(56) References Cited

U.S. PATENT DOCUMENTS 8,905,498 B2 12/2014 Hammerle
2011/0175508 A1* 7/2011 Rechberg ..... E05F 3/108 312/334.8
(Continued)

FOREIGN PATENT DOCUMENTS

DE 10 2009 012 922 9/2010
DE 10 2011 051 907 1/2013
(Continued)

OTHER PUBLICATIONS

International Search Report dated Oct. 31, 2016 in International (PCT) Application No. PCT/AT2016/060063.

*Primary Examiner* — Daniel J Rohrhoff
(74) *Attorney, Agent, or Firm* — Wenderoth, Lind & Ponack, L.L.P.

(57) ABSTRACT

A retraction device includes an entrainment member to be releasably coupled to the movable furniture part, and a spring device for applying a force to the entrainment member in a direction opposite to an extension direction of the entrainment member. The spring device can be tensioned in the extension direction of the entrainment member by a spring holder separate from the entrainment member. A coupling device can couple a movement between the entrainment member and the spring holder, and can vary the distance of a fastening location of the spring device relative to the entrainment member as the entrainment member extends in the extension direction. The coupling device includes a control element having a longitudinal axis extending in the extension direction. To vary the distance between the fastening location and the entrainment member, the control element rotates about its longitudinal axis when the entrainment member is extended in the extension direction.

15 Claims, 5 Drawing Sheets

(51) Int. Cl.

| | |
|---|---|
| ***E05F 5/02*** | (2006.01) |
| ***A47B 88/47*** | (2017.01) |
| ***A47B 88/49*** | (2017.01) |
| ***A47B 88/437*** | (2017.01) |
| ***A47B 88/467*** | (2017.01) |

(52) U.S. Cl.

CPC ..... *E05F 1/16* (2013.01); *E05F 5/003* (2013.01); *E05F 5/027* (2013.01); *A47B 88/47* (2017.01); *E05Y 2400/55* (2013.01); *E05Y 2800/24* (2013.01); *E05Y 2900/20* (2013.01)

(56) References Cited

U.S. PATENT DOCUMENTS

2013/0088132 A1* 4/2013 Hammerle ..... A47B 88/047 312/319.1
2013/0147335 A1* 6/2013 Chung ..... F25D 25/024 312/334.47
2013/0182978 A1* 7/2013 Huang ..... E05F 5/003 384/21
2014/0294328 A1* 10/2014 Pecar ..... A47B 88/04 384/20
2015/0098667 A1* 4/2015 Brunnmayr ..... A47B 88/04 384/21
2015/0204129 A1* 7/2015 Park ..... E05F 5/003 16/51
2015/0374124 A1* 12/2015 Brunnmayr ..... E05F 5/003 312/319.1
2015/0374125 A1* 12/2015 Goetz ..... A47B 88/463 312/319.1
2016/0138851 A1* 5/2016 Kim ..... A47B 88/467 312/405
2017/0196356 A1* 7/2017 Gasser ..... A47B 88/467
2017/0265644 A1* 9/2017 Fischer ..... E05F 1/16
2018/0055225 A1* 3/2018 Chen ..... A47B 88/49

FOREIGN PATENT DOCUMENTS

| | | |
|---|---|---|
| EP | 2 174 571 | 4/2010 |
| EP | 2 617 928 | 7/2013 |
| EP | 2 575 548 | 8/2017 |
| WO | 2011/150432 | 12/2011 |

* cited by examiner

SLIDE-IN DEVICE FOR MOVEABLE FURNITURE PARTS

BACKGROUND OF THE INVENTION

The present invention relates to a retraction device for retracting a movably-mounted furniture part into a closed end position relative to a furniture carcass, including:

an entrainment member which can be releasably coupled to the movable furniture part, at least one spring device for applying a force to the entrainment member in a direction opposite to an extension direction of the entrainment member, wherein the spring device can be tensioned in the extension direction of the entrainment member by a spring holder which is separate from the entrainment member, and a coupling device for coupling a movement between the entrainment member and the spring holder, wherein by the coupling device, the distance of a fastening location of the spring device on the spring holder relative to the entrainment member varies upon extending (moving) the entrainment member towards the extension direction.

The invention further relates to a drawer pull-out guide having a retraction device of the type to be described and an arrangement with a movably-mounted furniture part, in particular a flap, a door or a drawer, with such a retraction device for retracting the movable furniture part into a closed end position relative to a furniture carcass.

Retraction devices, in particular, are used in connection with drawers or sliding doors which are freely displaceable over a large part of their extension path and engaged by the entrainment member of the retraction device at the end of the closing movement, and are pulled by a spring force into the closed end position and are being held there with a predetermined closing force. Upon opening the movable furniture part, an operator firstly has to apply a force against the spring resistance of the retraction device, by pulling, until after a predetermined distance, the entrainment member is decoupled from the movable furniture part and is moved into a prestressed parking position in which the spring remains in a stressed ready position, so that in the next closing process, the movable furniture part can be pulled in again. For an operator, decoupling of the entrainment member in the opening movement for the drawer frequently makes itself noticeable with a jerky movement and with a clicking noise as, as a consequence of the sudden spring separation force, the drawer is freely movable and is accelerated unduly towards the opening direction by virtue of the previously exerted pulling force.

WO 2011/150432 A1 solves this problem by a spring holder which is separate from the entrainment member, and the spring holder is displaceably guided along a control curve. The entrainment member and the spring holder are thereby motionally coupled to one another by a coupling device in the form of interengaging tooth arrangements. Upon tensioning the spring device (i.e. upon opening the movable furniture part), the fastening location of the spring device on the spring holder falls back relative to the position of the entrainment member moving towards the extension direction, so that the movement of the fastening location of the spring device results slower than the movement of the entrainment member. The stressing of the spring device is thereby effected with reduced effort, and the undesired spring separation force and an undue acceleration of the movable furniture part can be avoided when the movable furniture part is decoupled from the entrainment member. A drawback of this construction is that the installation height of the retraction device is to be dimensioned relatively large due to the interengaging tooth arrangements.

SUMMARY OF THE INVENTION

It is an object of the present invention to propose a retraction device of the type mentioned in the introductory part, having a more compact construction.

According to the invention, the coupling device includes at least one control element having a longitudinal axis extending in the extension direction. In order to vary the distance which is present between the fastening location and the entrainment member, the control element pivots (rotates) at least partially about its longitudinal axis upon extending (moving) the entrainment member in the extension direction.

Accordingly, for coupling a movement between the entrainment member and the fastening location of the spring device on the spring holder, a coupling device configured as a force reduction mechanism is provided. The coupling device includes a control element which pivots about its own longitudinal axis as the entrainment member is being pulled outwardly. As a result, when the entrainment member is being pulled outwardly, the control element is forced to be moved with a movement component transverse to the extension direction of the entrainment member, so that the distance between the entrainment member and the fastening location is enlarged and the movement of the fastening location, upon extending (moving) the entrainment member, is decelerated relative to the entrainment member moving in the extension direction.

By a pivotal (rotational) movement of the control element about its own axis, the control element is guided with a component transverse to the extension direction of the entrainment member, so that the control element—with respect to the extension direction—covers less path than the entrainment member moving towards the extension direction. By the helical-shaped movement of the control element and the constant extension in space of the control element connected therewith, a very compact design of the retraction device is produced.

The control element can include at least one first guide element which, when the entrainment member is being pulled outwardly towards the extension direction, is guided, at least over a region, along a first guide track. Thereby, the first guide track can include a first section extending in the extension direction of the entrainment member and a helical-shaped second section adjoining the first section.

By the first section extending in the extension direction, the fastening location of the spring device, starting from the retracted end position of the entrainment member, can initially be moved with the same speed as the entrainment member towards the extension direction. By the helically-shaped second section (which has a component transverse to the extension direction of the entrainment member), the fastening location of the spring device on the spring holder falls back relative to the position of the moving entrainment member, so that at the end of the extension path of the entrainment member, the fastening location of the spring device on the spring holder is slower than the movement of the entrainment member. The pitch of the second section of the first guide track determines the degree of deceleration of the fastening location relative to the entrainment member.

By guiding the fastening location of the spring device along the helically-shaped second section, a continued, decelerated movement of the fastening location relative to the entrainment member moving towards the extension direction can be brought about, so that the spring device is not tensioned to its maximum extent. In order for the spring to be stressed, less physical effort is therefore required. The transition region and the load change, respectively, between the coupled and the decoupled position of the entrainment member can be harmonized, i.e. the undesired spring separation force and an undesired acceleration of the movable furniture part upon decoupling the entrainment member can be avoided therewith.

BRIEF DESCRIPTION OF THE DRAWINGS

Further details and advantages of the invention will be explained with the aid of the following description of figures, in which.

DETAILED DESCRIPTION OF THE INVENTION

Figure 1:
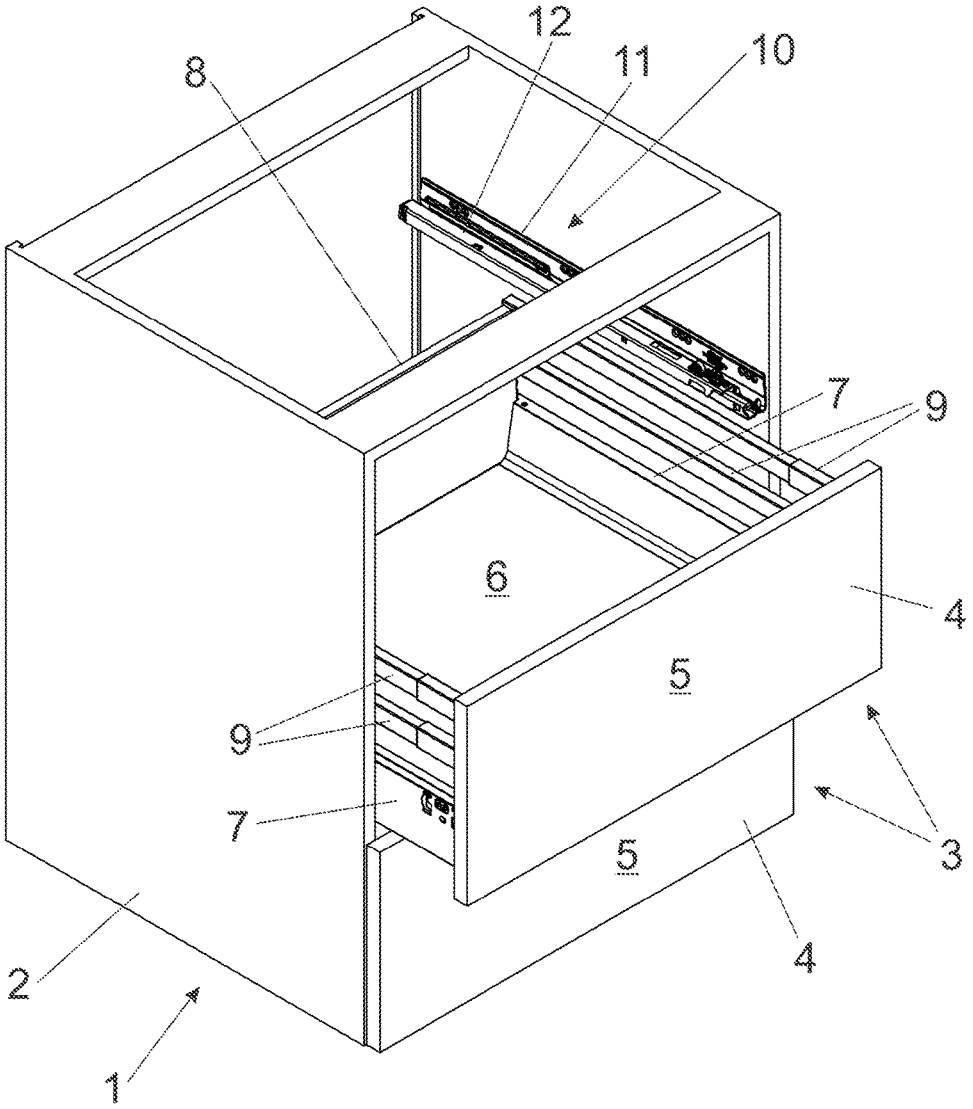
FIG. 1 is a perspective view of an item of furniture having a furniture carcass and drawers movably mounted relative thereto.

FIG. 1 shows an item of furniture 1 having a cupboard-shaped furniture carcass 2 and furniture parts 3 in form of drawers 4 which are movably-mounted relative to the furniture carcass 2. The drawers 4 each have a front panel 5, a drawer base 6, side walls 7 and a rear wall 8. Above the side walls 7, struts 9 are provided which extend between the front panel 5 and the rear wall 8 and which are provided for increasing the loading capacity of the drawer 4. For the displaceable support of the drawers 4 relative to the furniture carcass 2, drawer pull-out guides 10 are provided. The drawer pull-out guides 10 each have a carcass rail 11 to be fixed to the furniture carcass 2 and at least one extension rail 12 which is to be connected to the drawer 4 and which is displaceable relative to the stationary carcass rail 11. An additional displaceable central rail may be arranged between the carcass rail 11 and the extension rail 12 in order to enable a full extension for the drawer 4. Such a full extension is the case when the rear wall 8, in the fully extended position of the drawer 4, is arranged substantially flush with the front face of the furniture carcass 2.

Figure 2:
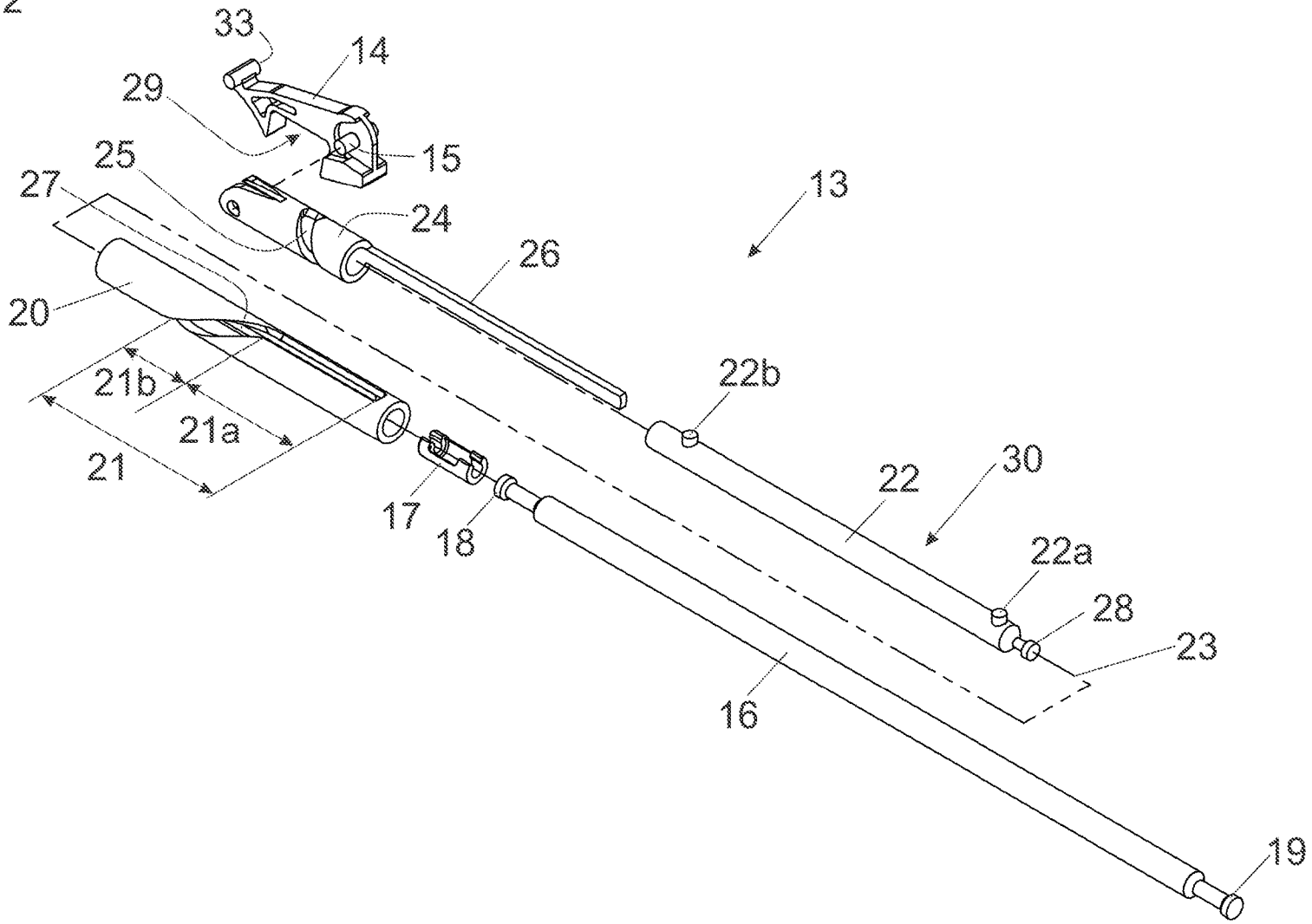
FIG. 2 is an exploded view of a retraction device for retracting a movably-mounted furniture part into a closed end position relative to a furniture carcass.
Figure 5A:
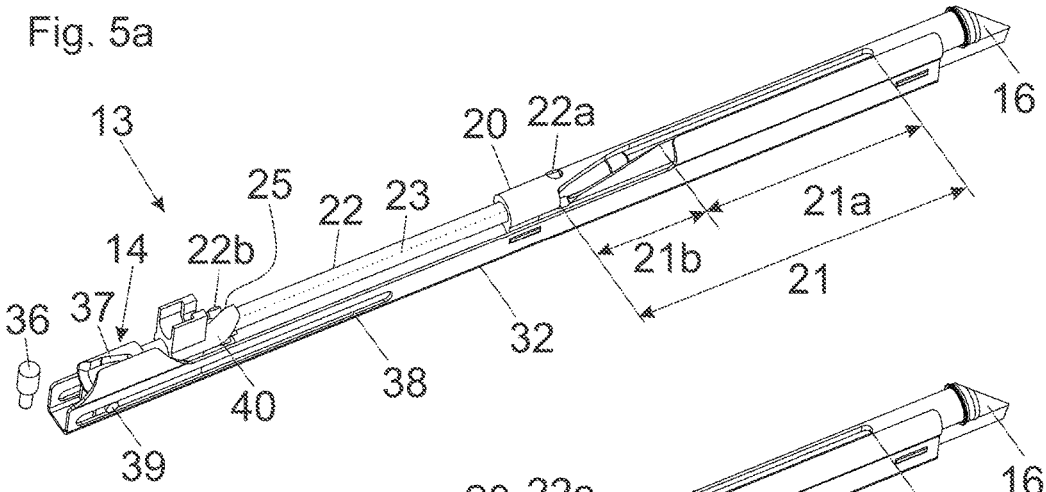
FIG. 5*a*-5*d* show a further embodiment of a retraction device having a pivotally mounted entrainment member in different retracting positions.
Figure 5B:
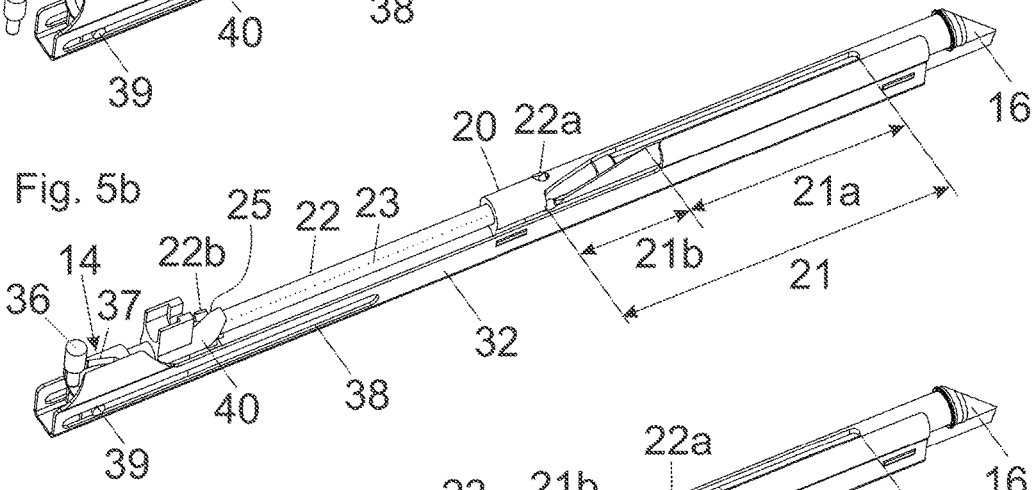

FIG. 2 shows an exploded view of a retraction device 13 by which a movably-mounted furniture part 3 can be retracted into the closed end position relative to the furniture carcass 2. The retraction device 13 includes—as commonly known—an entrainment member 14 which is tiltably (pivotably) mounted about a pivot axis 15 and which can be releasably coupled to the movable furniture part 3. For this purpose, the entrainment member 14 has a notch 29 configured to be releasably coupled to a coupling element 36 (see FIG. 5*a*-5*c*), for example in the form of a pin, being arranged on the movably-mounted furniture part 3. For applying a force to the entrainment member 14 in a direction opposite to the extension direction 31 (see FIG. 3*a*-3*c*), a spring device 16 is provided which preferably includes at least one helical spring in the form of a tension spring. For increasing the spring force, the spring device 16 can also include two or more tension springs switched in parallel relationship. The spring device 16 has a fastening location 18 at a first end for connecting to a spring holder 17 which is separate from the entrainment member 14. The other (second) end 19 of the spring device 16 is stationarily arranged in the mounting position (for example fixedly anchored to the carcass rail 11 of the drawer pull-out guide 10). Alternatively, it is possible that the retraction device 13 is arranged on the displaceable extension rail 12 so as to be displaceably arranged relative to the carcass rail 11, wherein the entrainment member 14 can be releasably coupled to a coupling element 36 arranged on the carcass rail 11.

For coupling a movement between the entrainment member 14 and the fastening location 18 of the spring device 16 on the spring holder 17, a coupling device 30 is provided which includes at least one control element 22 having a longitudinal axis 23. The control element 22 rotates about its longitudinal axis 23 when the entrainment member 14 is pulled outwardly. Upon a movement of the entrainment member 14 in the extension direction 31, the control element 22 performs a rotational movement about the longitudinal axis 23 and a translational movement along the longitudinal axis 23. The control element 22 includes at least one first guide element 22*a* which, when the entrainment member 14 is extended towards the extension direction 31, is guided, at least over a region, along a first guide track 21. In FIG. 2, the guide track 21 is formed or arranged on a first sleeve 20 and includes a first section 21*a* extending in the extension direction 31 and a helically-shaped second section 21*b* adjoining the first section 21*a*. When the entrainment member 14 is pulled outwardly, starting from the closed end position of the movable furniture part 3, the first guide element 22*a* of the control element 22 is guided along the first section 21*a*, during which there are equal movement ratios between the entrainment member 14 and the fastening location 18 of the spring device 16. At the end of the extension movement of the entrainment member 14, the first guide element 22*a* is guided along the helically-shaped second section 21*b* of the first guide track 21, whereby the control element 22 is guided with a movement-component transverse to the extension direction 31. In this way, the position of the fastening location 18 of the spring device 16 falls back relative to a position of the entrainment member 14 moving towards the extension direction 31 (in other words, the distance between the fastening location 18 and the entrainment member 14 increases). Therefore, the movement of the fastening location 18 is decelerated relative to the movement of the entrainment member 14.

As a consequence, the spring device 16 is not stressed to its maximum extent, so that the effect of the sudden spring separation force is prevented when the entrainment member 14 is decoupled from the movable furniture part 3.

On the opposing end region of the control element 22, a second guide element 22*b* is arranged, and the second guide element 22*b* is spaced from the first guide element 22*a* along the longitudinal axis 23. The second guide element 22*b* is displaceably arranged along a second guide track 25, and the second section 21*b* of the first guide track 21 and the second guide track 25, at least over a region, have an opposite sense of helix. The helically-shaped second guide track 25 is formed on a second sleeve 24, and the first sleeve 20 and the second sleeve 24 are connected to one another in a non-rotatable manner. This can be achieved by a limb 26 arranged on the second sleeve 24, wherein the limb 26 engages into a corresponding elongated recess 27 of the first sleeve 20. Accordingly, the first sleeve 20 is arranged so as to be stationary, while the second sleeve 24 can solely be displaced relative to the first sleeve 20 in an axial direction, but not rotated. The control element 22 is guided by the two guide elements 22*a*, 22*b* along the two guide tracks 21, 25 of the sleeves 20, 24. When the first guide element 22*a* interacts with the helically-shaped section 21*b* of the sleeve 20, the control element 22 rotates about its longitudinal axis 23. As a consequence, the control element 22 brings about a decelerated movement of the fastening location 18 relative to the moving entrainment member 14.

Figure 3A:
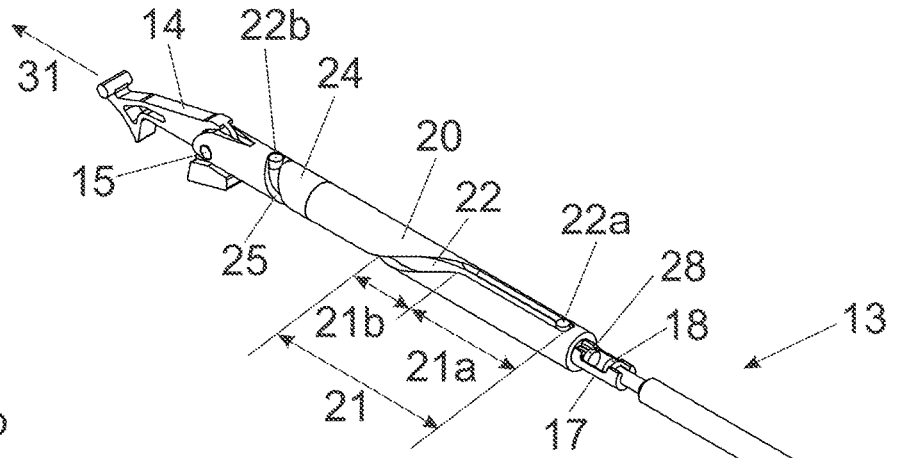
FIG. 3*a*-3*c* are perspective views of the retraction device with different positions of the entrainment member in the extension direction.
Figure 3B:
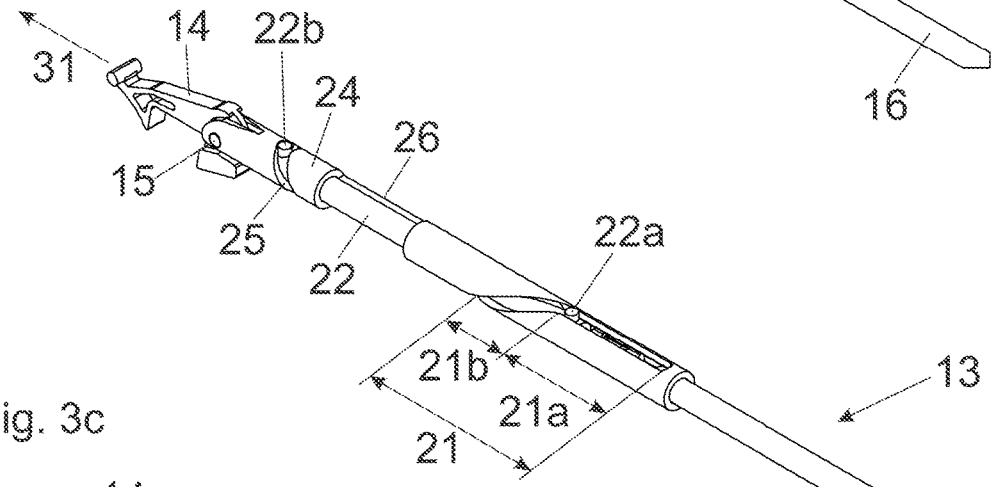
Figure 3C:
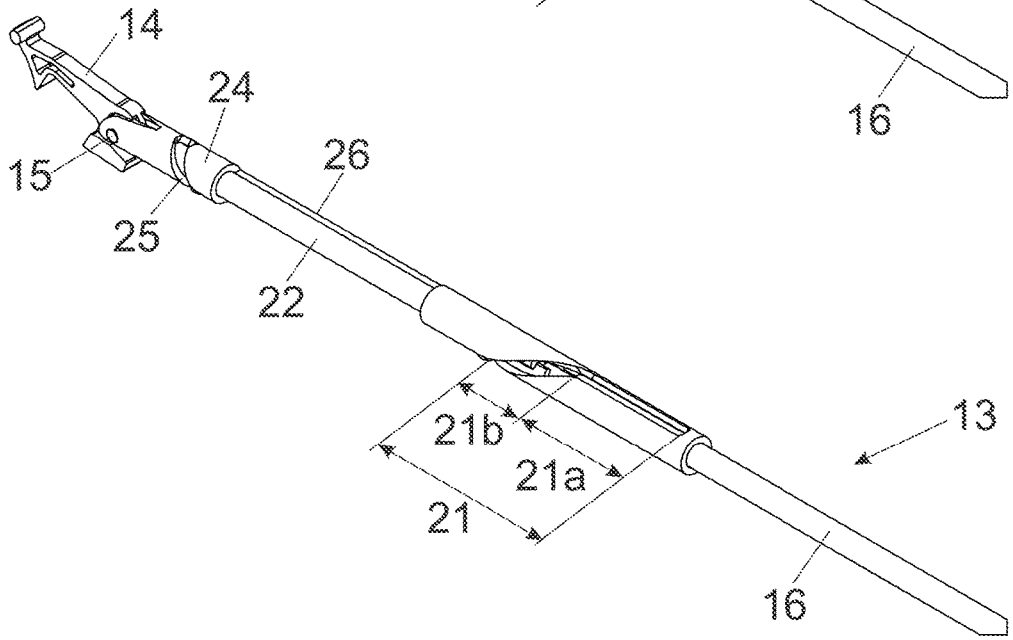

FIG. 3*a*-3*c* show the retraction device 13 with different positions of the entrainment member 14 in the extension direction 31. FIG. 3*a* shows the retracted end position of the entrainment member 14, wherein the spring device 16 is substantially in a relaxed condition. The spring device 16 is connected to the spring holder 17 by the fastening location 18, and the spring holder 17 is connected to the guide element 22 by a coupling portion 28. The first guide element 22*a* is located on a first end of the first section 21*a* of the first guide track 21, while the second guide element 22*b* interacts with the helically-shaped second guide track 25 of the second sleeve 24. In the retracted end position of the entrainment member 14, the front faces of the two sleeves 20, 24 rest against each other, and the control element 22 is accommodated within the two sleeves 20, 24. In this way, a very compact structure is brought about.

FIG. 3*b* shows a slight extended position of the entrainment member 14 which, by manually applying a pulling force to the movable furniture part 3 in the extension direction, is movable against the force of the spring device 16. The first guide element 22*a* of the control element 22 is initially guided along the straight first section 21*a* of the first guide track 21 extending in the extension direction 31, and the fastening location 18 moves with the same speed as the entrainment member 14. The distance D (FIG. 4*a*, 4*b*) of the fastening location 18 relative to the entrainment member 14 remains, for the present, constant. After reaching the position shown in FIG. 3*b*, the first guide element 22*a* interacts with the helically-shaped second section 21*b* of the first guide track 21. Thereby, the control element 22 is guided with a movement-component transverse to the extension direction 31, whereby the distance D1 (FIG. 4*c*) between the fastening location 18 and the entrainment member 14 is enlarged, and thus the speed of the fastening location 18 is decelerated relative to the speed of the entrainment member 14. FIG. 3*c* shows the fully extended position of the entrainment member 14, wherein the first guide element 22*a* is located at the end of the second section 21*b* of the first guide track 21.

Figure 4A:
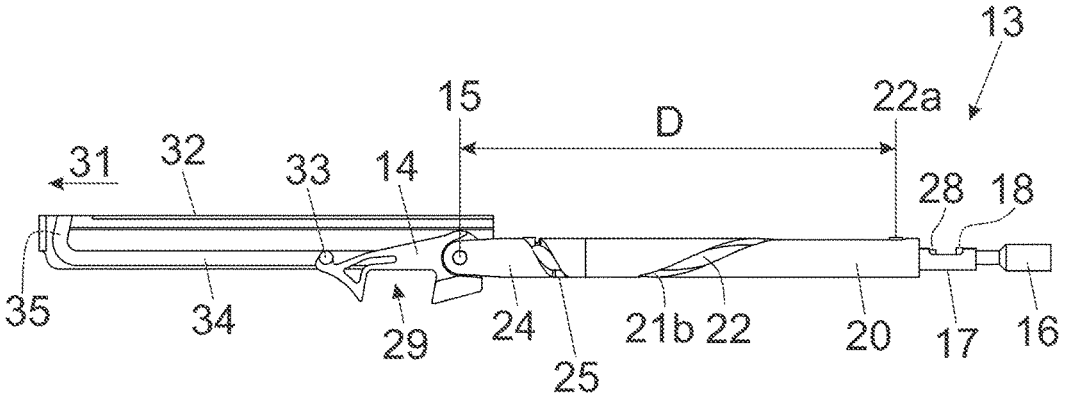
FIG. 4*a*-4*c* are side views of the retraction device with different positions of the entrainment member in the extension direction.
Figure 4B:
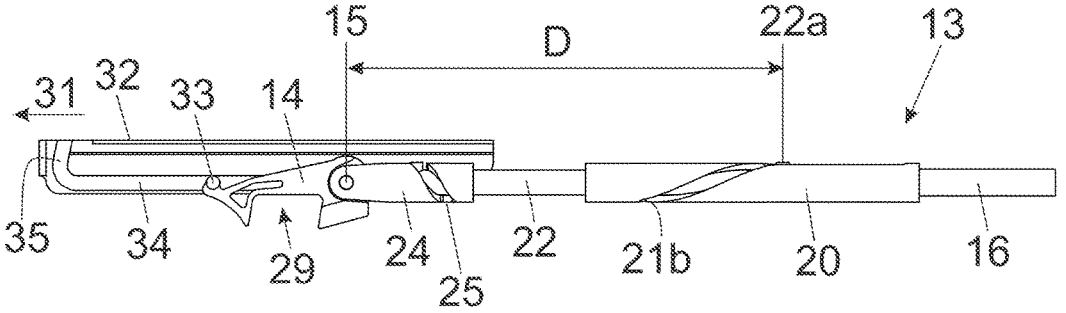
Figure 4C:
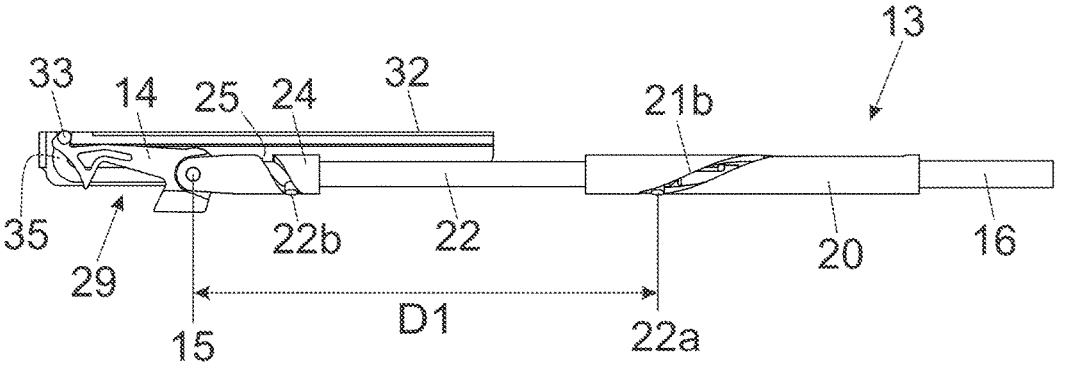

FIG. 4*a*-4*c* show side views of the retraction device 13 with different positions of the entrainment member 14 in the extension direction 31. The retraction device 13 has a housing 32 on which a linear displacement path 34 extending in the extension direction 31 for guiding the entrainment member 14 is arranged or formed. A bend 35, which preferably has a curved or edged configuration, for releasably locking the entrainment member 14 adjoins the linear displacement path 34. The entrainment member 14 is provided with a guide portion 33 by which the entrainment member 14 can be guided along the linear displacement path 34 and can be releasably coupled to the bend 35. Starting from the retracted end position of the entrainment member 14 according to FIG. 4*a*, the entrainment member 14—triggered by a manual pulling motion applied to the movable furniture part 3—is moved in the extension direction 31, wherein the first guide element 22*a* of the control element 22 is moved along the straight first section 21*a* of the first guide track 21 extending in the extension direction 31. The distance D, which is present between the axis 15 of the entrainment member 14 and the first guide element 22*a*, remains initially constant. Starting from the extension position of the entrainment member 14 according to FIG. 4*b*, the first guide element 22*a* is moved along the helically-shaped second section 21*b* of the first guide track 21 and the second guide element 22*b* is moved along the helically-shaped second guide track 25 which has a "twist" shape opposite to that of the second section 21*b*. Due to movement of the second guide element 22*b* in the helical second guide track 25, the fastening location 18 of the spring device 16 on the spring holder 17 falls back relative to the position of the entrainment member 14 moving in the extension direction 31. Accordingly, the distance D1—in comparison with the distance D according to FIG. 4*a* and FIG. 4*b*—is enlarged. The guide portion 33 of the entrainment member 14 moves into the bend 35, whereby the entrainment member 14 pivots about the pivot axis 15 and the notch 29 of the entrainment member 14 releases the coupling element 36 (FIG. 5*a*-5*d*) of the movable furniture part 3. The uncoupled movable furniture part 3 can subsequently be moved further in the extension direction 31. In FIG. 4*c*, the entrainment member 14 is located in a self-locking arrested ready-position for a retraction process of the movable furniture part 3 in a direction opposing the extension direction 31. Upon closing the movable furniture part 3, the furniture part 3 can namely be coupled again to the notch 29 of the entrainment member 14, so that the guide portion 33 moves out of the bend 35 and the entrainment member 14 is again pulled into the retracted end position according to FIG. 4*a* by the force of the relaxing spring device 16.

FIG. 5*a*-5*d* show a further embodiment of a retraction device 13 having a pivotally-mounted entrainment member 14 in different retraction positions. Visible is a coupling element 36 to be fixed to the movable furniture part 3, the coupling element 36 can be releasably coupled to the entrainment member 14. The pivotable entrainment member 14 is coaxially arranged relative to the longitudinal direction 23 of the control element 22 and includes an inclined surface 37 extending transverse to the extension direction 31. When the inclined surface 37 interacts with the coupling element 36, the inclined surface 37 rotates the entrainment member 14 about the longitudinal axis 23, so that the control element 22 is also rotated therewith about the longitudinal axis 23 and the first guide element 22*a* of the control element 22 is being released from the locking position with the second section 21*b* of the first guide track 21. It is preferably provided that the entrainment member 14, together with the control element 22, has a one-piece configuration and is arranged on a slider 40 which is displaceably guided along a linear guide 38 of the housing 32 by bolts 39 arranged on the slider 40. The second guide track 25 is formed on the linearly displaceable slider 40, wherein the second guide track 25 interacts with the second guide element 22*b* of the control element 22.

Figure 5C:
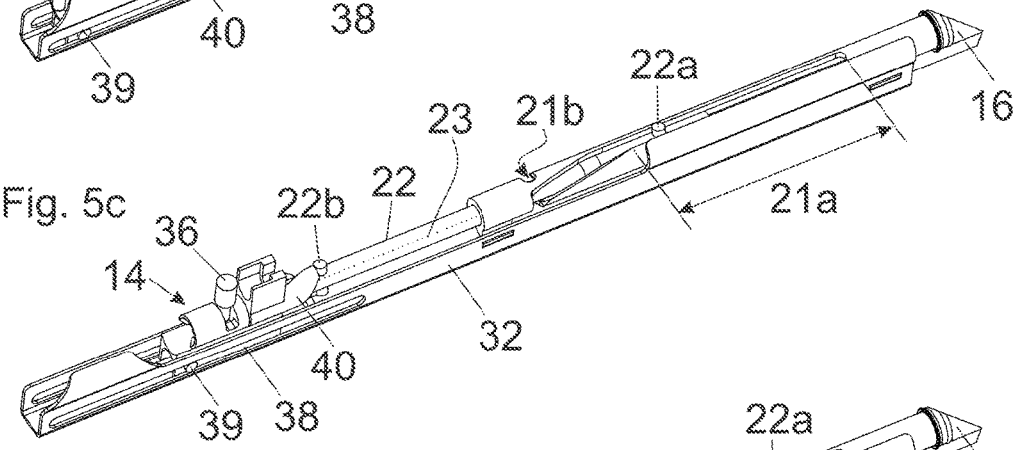
Figure 5D:
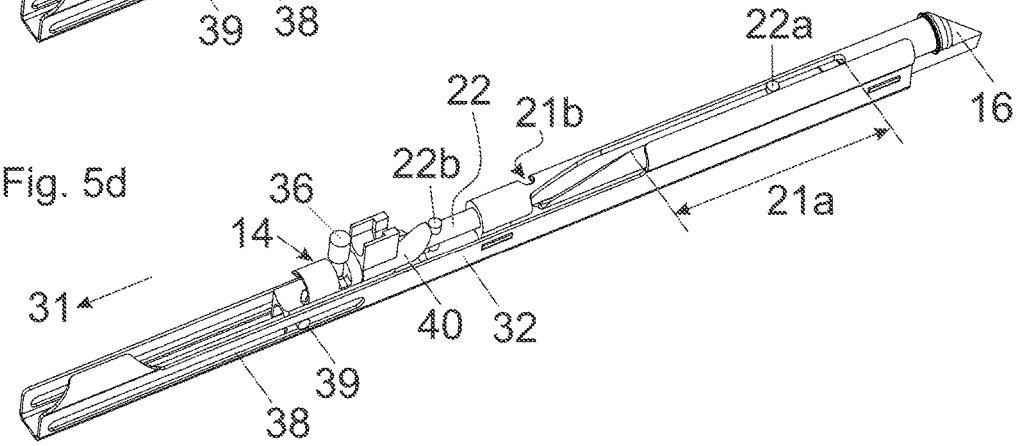

When now the movable furniture part 3 is being closed (FIG. 3*b*), the coupling element 36 interacts with the inclined surface 37 of the entrainment member 14. In this way, the entrainment member 14 is pivoted about the longitudinal axis 23 and is coupled to the coupling element 36, wherein the first guide element 22*a* of the control element 22, by a pivotal movement of the control element 22 about the pivoting axis 23, is released from the locking position with the second section 21*b* of the first guide track 21 and the entrainment member 14 which is coupled to the coupling element 36, together with the control element 22, is retracted in a direction towards the closed end position by the force of the discharging spring device 16 (FIG. 5*c*). The first guide element 22*a* now interacts with the first section 21*a* of the first guide track 21 extending in the extension direction 31, so that the entrainment member 14, together with the control element 22, is displaced along the longitudinal axis 23 in a direction towards the closed position, without performing a rotational movement. In FIG. 5*c*, also the end of the second section 21*b* of the first guide track 21 is visible, and the end of the second section 21*b*, for releasably locking the first guide element 22*a*, includes a portion extending at a right angle relative to the pivoting axis 23. Starting from the position of the entrainment member 14 shown in FIG. 5*c*, the entrainment member 14 can be retracted, together with the control pin 22, into the complete end position. When now the movable furniture part 3 is again opened, the entrainment member 14, starting from FIG. 5*d*, is again pulled outwardly by the coupling element 36 towards the extension direction 31. The control element 22, at the end of this extension movement, rotates again about the pivoting axis 23 by the guide elements 22*a*, 22*b* interacting with the guide tracks 21, 25, so that the entrainment member 14 is also being rotated about the pivoting axis 23 and the coupling element 36 is being released from the entrainment member 14 for the further extension movement.

The invention claimed is:

1. A retraction device for retracting a movably-mounted furniture part into a closed end position relative to a furniture carcass, said retraction device comprising:

an entrainment member to be releasably coupled to the movable furniture part;

a spring device for applying a force to the entrainment member in a direction opposite to an extension direction of the entrainment member, wherein the spring device is configured to be tensioned in the extension direction of the entrainment member by a spring holder separate from the entrainment member; and a coupling device for coupling a movement between the entrainment member and the spring holder, the coupling device being configured to vary a distance between a fastening location of the spring device on the spring holder and the entrainment member upon movement of the entrainment member in the extension direction, wherein the coupling device includes a control element having a longitudinal axis extending in the extension direction, the control element being configured to rotate at least partially about the longitudinal axis upon movement of the entrainment member in the extension direction to vary the distance between the fastening location and the entrainment member.

2. The retraction device according to claim 1, wherein the control element includes a first guide element configured to be guided along a first guide track upon movement of the entrainment member towards the extension direction.

3. The retraction device according to claim 2, wherein the first guide track includes a first section extending in the extension direction of the entrainment member, and a helically-shaped second section adjoining the first section.

4. The retraction device according to claim 2, wherein the control element includes a second guide element configured to be guided along a second guide track upon movement of the entrainment member in the extension direction.

5. The retraction device according to claim 4, wherein the second guide track is helically-shaped at least over a region.

6. The retraction device according to claim 4, wherein the first guide element and the second guide element are spaced from each other along the longitudinal axis of the control element.

7. The retraction device according to claim 4, wherein the first guide track is formed or arranged on a first sleeve, and the second guide track is formed or arranged on a second sleeve.

8. The retraction device according to claim 7, wherein the first sleeve and the second sleeve are connected to one another in a non-rotatable manner.

9. The retraction device according to claim 8, wherein the first sleeve and the second sleeve are connected to one another in the non-rotatable manner by a limb.

10. The retraction device according to claim 7, wherein at least one of the control element and the spring device is guided within the first sleeve or the second sleeve upon movement of the entrainment member in the extension direction.

11. The retraction device according to claim 4, wherein the first guide track and the second guide track have an opposite sense of helix.

12. A drawer pull-out guide comprising the retraction device according to claim 1.

13. The drawer pull-out guide according to claim 12, wherein the drawer pull-out guide further comprises a carcass rail to be fixed to a furniture carcass, and an extension rail displaceable relative to the carcass rail, wherein the extension rail is retractable into a fully closed end position by the retraction device at an end of the closing movement.

14. An arrangement comprising a movable furniture part and the retraction device according to claim 1 for retracting the movable furniture part into the closed end position relative to a furniture carcass.

15. The arrangement according to claim 14, wherein the movable furniture part is one of a flap, a door, or a drawer.

* * * * *